United States Patent [19]

Vorhauer

[11] Patent Number: 5,011,334

[45] Date of Patent: Apr. 30, 1991

[54] BUOYANCY COMPENSATOR WITH INTERCHANGEABLE ACCESSORIES

[75] Inventor: Marjorie Vorhauer, Spring Valley, Calif.

[73] Assignee: Soniform, Inc., El Cajon, Calif.

[21] Appl. No.: 370,271

[22] Filed: Jun. 22, 1989

[51] Int. Cl.[5] ..... B63C 9/24

[52] U.S. Cl. ..... 405/186; D21/238; D21/225; 441/108; 441/89; 2/16; 2/22; 2/24

[58] Field of Search ..... 405/186, 185; 441/106, 441/89, 114–118; 2/51, 62, 54, 16, 59, 22, 46, 24, 48, 74, 69.5, 2.1 R, 2; D2/225, 183, 184, 191; D21/238

[56] References Cited

U.S. PATENT DOCUMENTS

| | | | |
|---|---|---|---|
| 699,802 | 5/1902 | Mendelsohn | D2/225 |
| 932,990 | 8/1909 | Madill et al. | 2/24 X |
| 1,478,239 | 12/1923 | Marengo . | |
| 1,862,070 | 6/1932 | Summerson . | |
| 2,244,871 | 6/1941 | Guinzburg | 2/16 X |
| 2,568,083 | 9/1951 | Mitchell | 2/62 X |
| 2,851,707 | 9/1958 | Samuels | 405/186 X |
| 3,336,613 | 8/1967 | Wales | D21/238 X |
| 3,496,572 | 2/1970 | Herzig | 2/79 X |
| 4,137,585 | 2/1979 | Wright . | |
| 4,194,257 | 3/1980 | Martin . | |
| 4,229,833 | 10/1980 | Cox et al. | 2/16 |
| 4,483,019 | 11/1984 | Spangrud et al. | 2/2.1 R |
| 4,496,328 | 1/1985 | Asher . | |
| 4,503,566 | 3/1985 | Wheeler | 2/22 |
| 4,517,230 | 5/1985 | Crawford | 2/94 X |
| 4,523,914 | 6/1985 | Faulconer . | |
| 4,561,853 | 12/1985 | Faulconer . | |
| 4,694,772 | 9/1987 | Faulconer . | |
| 4,752,263 | 6/1988 | Pritchard et al. | 405/186 X |
| 4,810,134 | 3/1989 | Eaulconer et al. | 405/186 |

FOREIGN PATENT DOCUMENTS

| | | | |
|---|---|---|---|
| 3743 | 1/1902 | United Kingdom | D2/225 |

*Primary Examiner*—Dennis L. Taylor

[57] ABSTRACT

A buoyancy compensator includes detachable pockets which are removably attached to one or more flaps of the buoyancy compensator. The pockets can have different colors, designs, or indicia so that the appearance of the buoyancy compensator can be varied as desired. Each pocket includes a hook and loop fastener which can be attached to a hook and loop fastener on the associated strap.

14 Claims, 3 Drawing Sheets

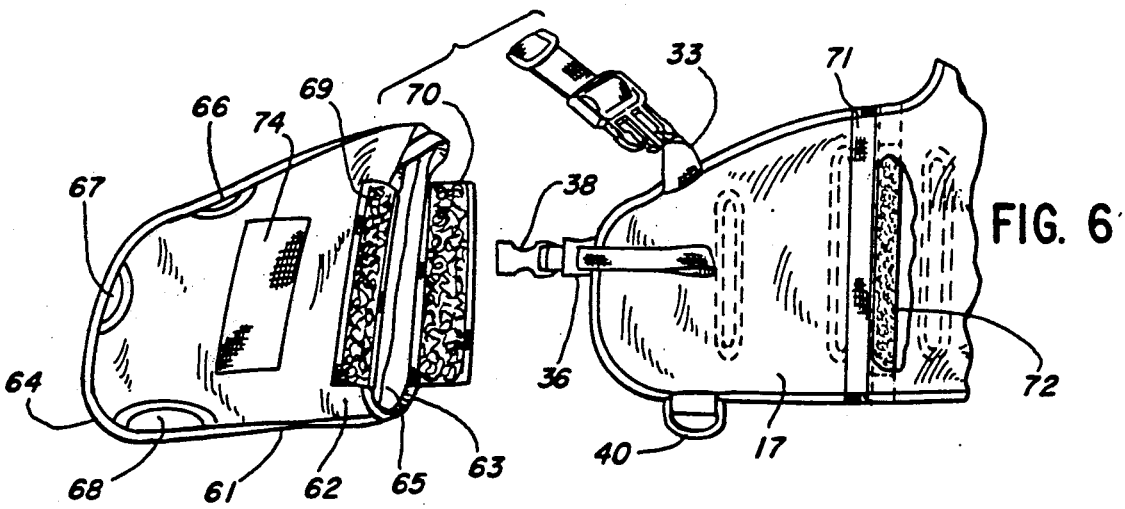
FIG. 6
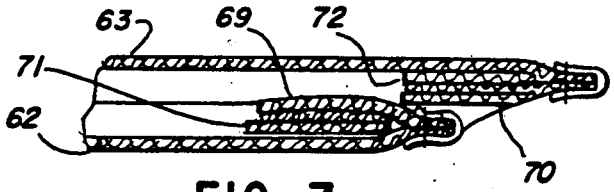
FIG. 7
FIG. 8
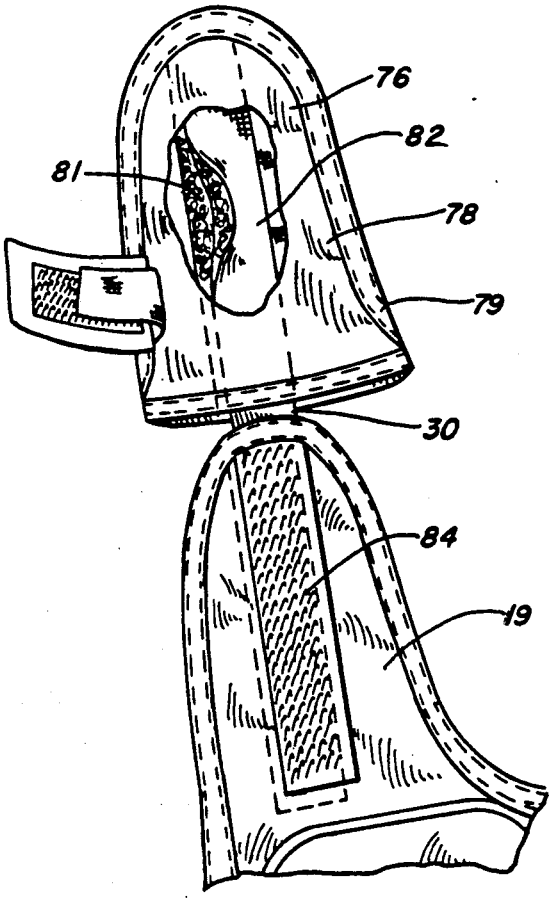
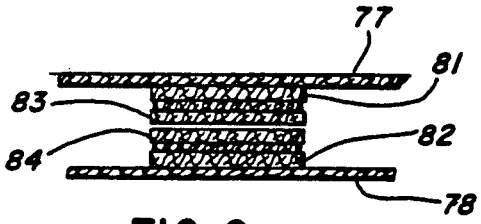
FIG. 9

BUOYANCY COMPENSATOR WITH INTERCHANGEABLE ACCESSORIES

BACKGROUND AND SUMMARY

This invention relates to buoyancy compensators, and, more particularly, to a buoyancy compensator with interchangeable accessories which are removably attached to the buoyancy compensator.

Buoyancy compensators are commonly provided in a form similar to a life vest and include a bladder inside the vest. Buoyancy compensators are described, for example, in U.S. Pat. Nos. 4,694,772, 4,561,853, 4,523,914, and 4,137,585.

A buoyancy compensator is used by a scuba diver to adjust his buoyancy during a dive. The bladder can be inflated with air to increase the diver's buoyancy and deflated when the diver wants to descend to a lower level.

Until now the color and appearance of a buoyancy compensator was fixed when it left the manufacturer. There was no opportunity to customize the buoyancy compensator to provide different colors or to provide different inidicia for tailoring the buoyancy compensator to a particular field, such as spear fishing, underwater photography, underwater ship repairing, etc.

The invention provides a buoyancy compensator with interchangeable accessories which can be used to customize the buoyancy compensator by the retailer at the point-of-purchase or by the user after purchase. One or more removable pockets or sleeves can be inserted over one or more flaps on the vest-shaped buoyancy compensator and releasably attached, for example, by hook and loop fasteners. The pockets can be provided in different colors, or the pockets can bear indicia, designs, logos, etc. for customizing the buoyancy compensator. The pockets can be removed and interchanged as desired.

DESCRIPTION OF THE DRAWING

The invention will be explained in conjunction with an illustrative embodiment shown in the accompanying drawing, in which

FIG. 6 is a fragmentary view illustrating the removal of one of the pockets for the side flaps;

FIG. 7 is a fragmentary sectional view taken along the line 7—7 of FIG. 2;

FIG. 8 is a fragmentary view illustrating the removal of one of the pockets for the shoulder flaps; and FIG. 9 is a fragmentary sectional view taken along the line 9—9 of FIG. 2.

DESCRIPTION OF SPECIFIC EMBODIMENT

Figure 3:
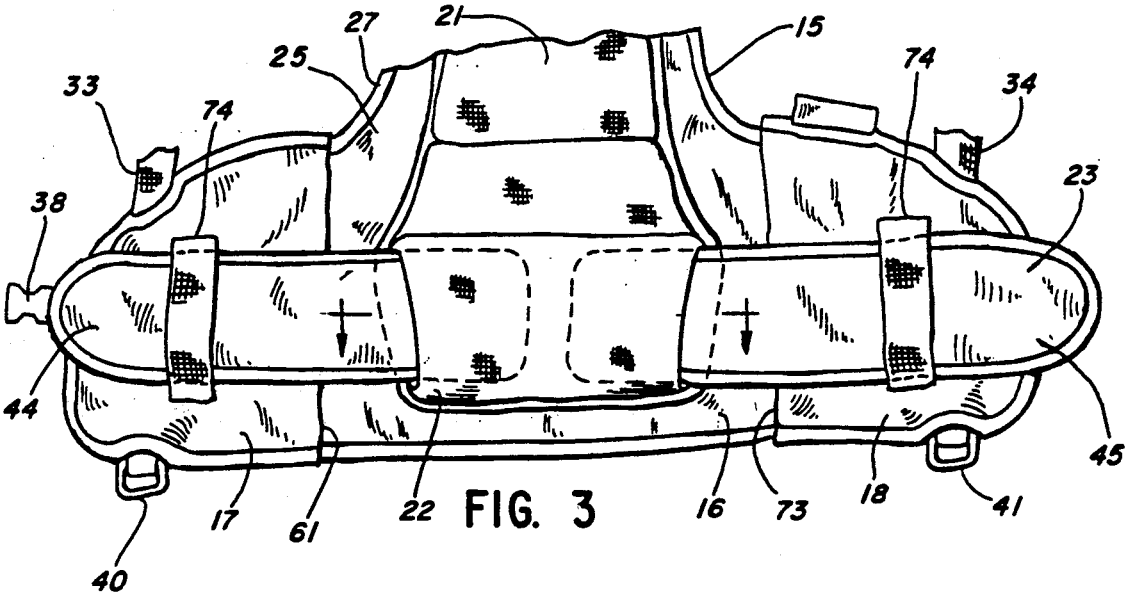
FIG. 3 is a fragmentary view similar to FIG. 2 showing the cummerbund or waist band in an open position.
Figure 5:
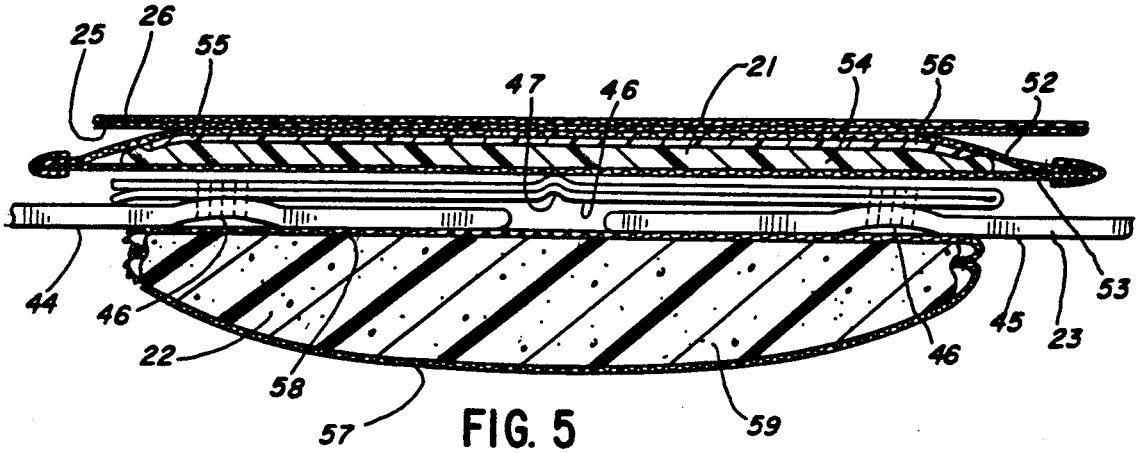
FIG. 5 is a fragmentary sectional view taken along the line 5—5 of FIG. 3.

The numeral 14 designates generally a buoyancy compensator which includes a vest 15 having a back portion 16, right and left side flaps 17 and 18, and right and left shoulder portions 19 and 20. A back pad 21 is attached to the inside surface of the back and includes an enlarged lumbar pad 22 (FIGS. 3 and 5). A cummerbund or waist band 23 is attached to the back portion behind the lumbar pad. Conventional means for mounting a tank of compressed breathing gas can be mounted on the outside surface of the back portion.

The vest is formed from two layers of nylon fabric 25 and 26 (FIG. 5) which are secured around their edges by a binding 27 which is stitched to the fabric layers. The fabric layers enclose a conventional air bladder which can either be provided separately or can be formed by an air-impermeable layer on the inside of the fabric. In the latter case, the vest is formed from thermoplastic coated nylon pack cloth which is electronically heat-sealed together. The coating seals the fabric and creates an air chamber when the two layers are welded together. The bladder is inflated by a conventional inflator tube 28 which is well known in the art.

Straps 30 and 31 are attached to the right and left shoulder flaps, respectively, and each of the straps include a conventional quick release female buckle 32. Vertical straps 33 and 34 are attached to the right and left side flaps 17 and 18, and each of the straps includes a conventional quick release male buckle 35 which is adapted to connect to one of the female buckles 32. Horizontal straps 36 and 37 are attached to the ends of the side flaps and include female and male buckles 38 and 39, respectively, which are adapted to connect together. D-rings 40 and 41 are attached to the lower edges of the side flaps.

Figure 4:
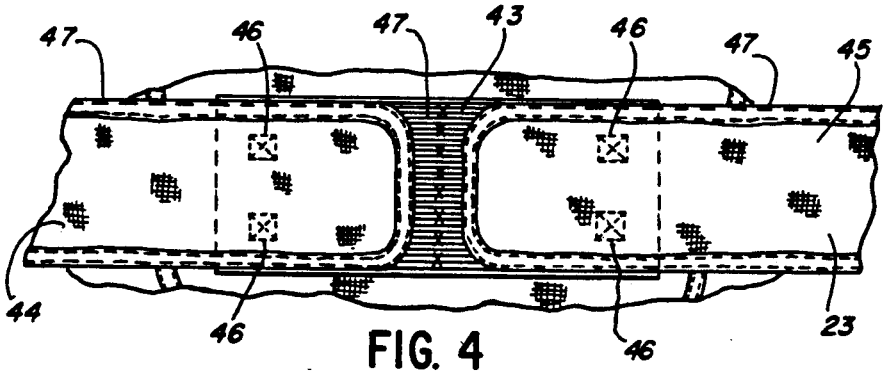
FIG. 4 is a fragmentary view of the central portion of the cummerbund.

The cummerbund 23 includes an elastic middle portion 43 (FIGS. 4 and 5) and right and left end portions 44 and 45. Referring to FIG. 5, the elastic middle portion is provided by a double layer of elastic fabric, and each of the end portions 44 and 45 are stitched to the elastic fabric and two rectangular areas 46. The center of the elastic fabric 43 is stitched at 47 to the back pad 21. Each of the end portions 44 and 45 of the cummerbund is advantageously formed from two layers of non-elastic nylon fabric and an edge binding 47 which is stitched together around the periphery of the fabric. The three ends of the end portions 44 and 45 include mating hook and loop fasteners 48 and 49, respectively (see FIG. 2). The hook and loop fasteners can be of the type which is sold under the trademark Velcro.

Still referring to FIG. 5, the back pad 21 includes inner and outer layers 52 and 53 and a cushion 54. The outer layer 53 is attached to the inner layer of the vest by two lines of stitching 55 and 56. The lumbar pad 22 includes inner and outer layers 57 and 58 which enclose a cushion 59.

Figure 2:
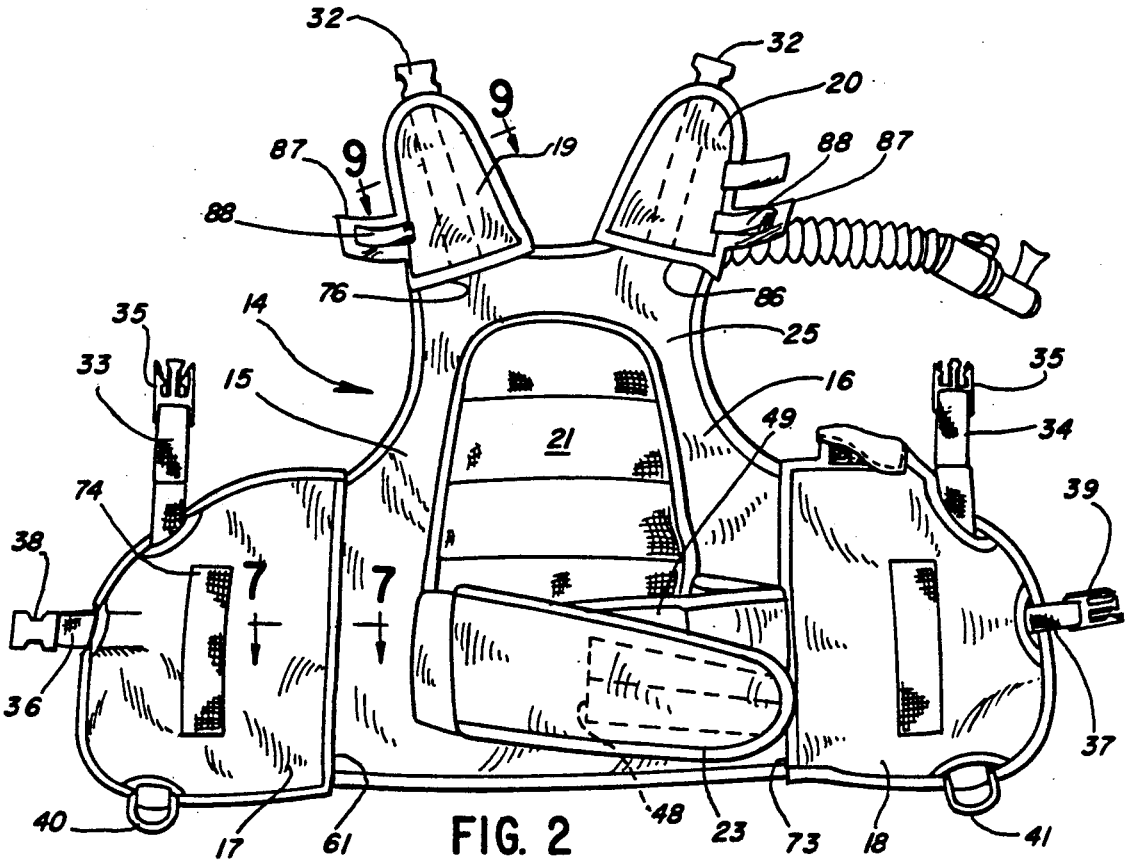
FIG. 2 is plan view of the buoyancy compensator of FIG. 1.

Comparing FIGS. 2 and 6, the right side flap 17 of the vest is covered by a removable pocket or sleeve 61 which has a shape complementary to the shape of the flap. The pocket 61 includes fabric layers 62 and 63 and a binding 64 which is stitched to the peripheries of the layers 62 and 63. The layers provide a receptacle 65 into which the side flap 17 can be inserted. Openings 66, 67, and 68 are provided in the inner layer 62 for the straps 33 and 36 and D-ring 40, respectively, on the flap.

The pocket 61 is removably secured to the side flap 17 by a pair of hook and loop fastener pads 69 and 70 which are secured to the layers 62 and 63 adjacent the open end of the pocket and a pair of hook and loop fastener straps 71 and 72 which are secured to the side flap. The fastener sides of the straps 71 and 72 face inwardly, and only the ends of the straps are stitched to the side flap. After the pocket is inserted over the side flap, the pocket is secured by reversely folding the pads 69 and 70 underneath the straps 71 and 72, respectively, between the straps and the adjacent surface of the side flap as illustrated in FIG. 7. The pocket is thereby securely held against inadvertent removal from the side flap.

The left side flap 18 is similarly covered by a removable pocket 73 which is the mirror image of the pocket 61.

Each of the pockets 61 and 73 for the side flaps includes a strap 74 (FIG. 3) through which the cummerbund 23 extends. Only the ends of the straps are secured to the pocket so that the cummerbund can slide between the strap and the pocket.

Figure 1:
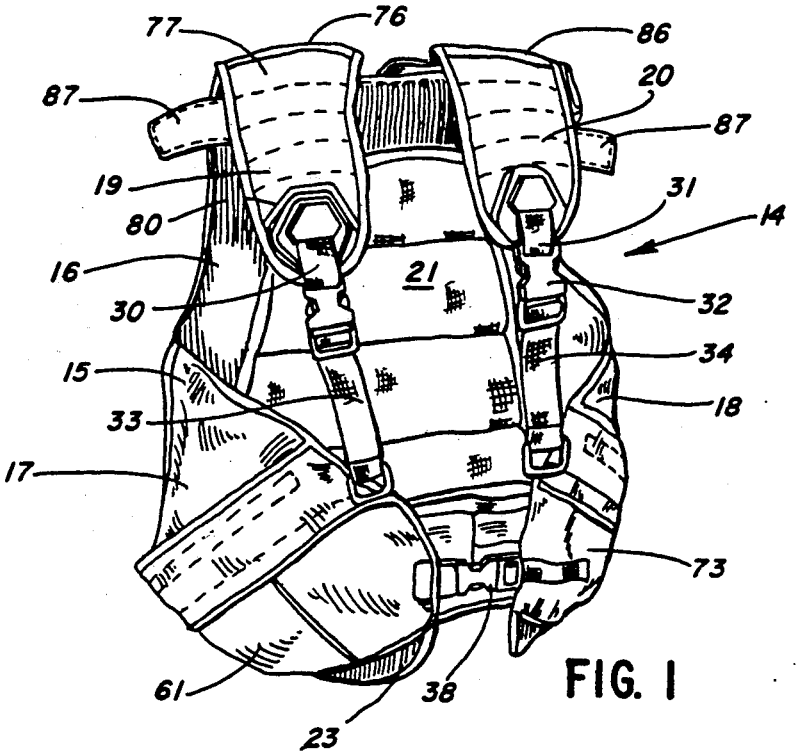
FIG. 1 is a perspective view of a buoyancy compensator formed in accordance with the invention.

Comparing FIGS. 2 and 8, the right shoulder flap 19 of the vest is covered by a removable pocket or sleeve 76 which has a shape complementary to the shape of the shoulder flap. The pocket includes a pair of fabric layers 77 and 78 (FIGS. 1 and 8) and a binding 79 which is secured to the periphery of the layers. An opening 80 (FIG. 1) is provided in the layer 78 for the strap 30.

The shoulder pocket 76 is removably secured to the shoulder flap 19 by a pair of hook and loop fastener straps 81 and 82 (FIGS. 8 and 9) which are secured to the inside of the layers 77 and 78 and a pair of hook and loop fastener straps 83 and 84 which are secured to the outside of the shoulder flap.

The left shoulder flap 20 is similarly covered by a removable pocket 86 which is the mirror image of pocket 76. In the embodiment illustrated, each of the shoulder pockets is provided with a pair of complementary hook and fasteners tabs 87 and 88 for securing breathing tubes or the like.

The diver dons the buoyancy compensator by wrapping the cummerbund 23 around his waist and securing the ends with the hook and loop fasteners 48 and 49. Thereafter, the right and left side flaps 17 and 18 are secured together in front of the cummerbund by the mating buckles 38 and 39. The right side flap is secured to the right shoulder flap by the straps 30 and 33 and the mating buckles 33 and 35. The left side flap is secured to the left shoulder flap by the straps 31 and 34 and the buckles 32 and 35.

The diver inflates or deflates the bladder of the buoyancy compensator through the inflator tube 28 in the conventional manner in order to adjust his buoyancy. As the bladder is inflated and deflated, the diver adjusts the straps which connect the side flaps and shoulder flaps in order to retain the buoyancy compensator comfortably and snugly about his body. Also, as the diver descends or ascends during a dive, compression on his wet suit increases or decreases, which may also require adjustment of the straps. However, since the cummerbund includes the elastic central portion 43, the length of the cummerbund automatically adjusts by expansion or contraction of the elastic portion, and the diver does not have to adjust the cummerbund.

Since the side flap pockets 61 and 73 and shoulder flap pockets 76 and 86 are formed separately from the vest, the pockets can be made of different material and different colors than the vest. The pockets can also be customized by attaching logos or indicia relating to various end uses such as spear fishing, underwater photography, etc. A retailer of the buoyancy compensator can stock the side pockets and shoulder pockets in various colors or customized versions, all of which can be attached to a single style of vest. When a customer purchases a buoyancy compensator, the desired accessory pockets can be attached by the retailer at the point of sale. Alternatively, the diver can buy a variety of accessory pockets and interchange them as desired.

Each side pocket can be attached simply by inserting the side flap into the pocket, pulling the straps 33 and 36 and the D-ring 40 through the appropriate openings in the pocket, and securing the hook and loop fasteners. The shoulder flaps are attached in a similar manner. In order to change pockets, the reverse procedure is followed.

When the buoyancy compensator includes an expandable cummerbund which includes an elastic central portion, the means for mounting the breathing tank on the buoyancy compensator is preferably a so-called "softpack" assembly available from Soniform, Inc. which does not include a rigid frame. However, the buoyancy compensator can also be provided with a conventional non-expanding cummerbund. In that event the breathing tank is preferably secured by an industry standard "hardpack" assembly which includes a rigid frame.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A buoyancy compensator comprising a vest having a back portion, right and left side flaps, and right and left shoulder flaps, a pocket removably inserted over one of the flaps, said one of said flaps extending into but not through said pocket, and means for removably attaching the pocket to said one flap.

2. The buoyancy compensator of claim 1 including a strap attached to said one flap for securing the flap to another portion of the buoyancy compensator, the pocket being provided with an opening through which the strap extends.

3. The buoyancy compensator of claim 1 in which the means for attaching the pocket includes a hook and loop fastener on said one flap and a hook and loop fastener on the pocket.

4. The buoyancy compensator of claim 3 in which the hook and loop fastener on said one flap is attached to a strap having a pair of ends secured to the flap and the hook and loop fastener on the pocket is attached to a flap which is reversely folded over the strap.

5. A buoyancy compensator comprising a vest having a back portion, right and left side flaps, and right and left shoulder flaps, right and left side flap pockets removably inserted over the right and left side flaps, respectively, said right and left flaps extending into but not through said right and left pockets, and means for removably attaching the pockets to said flaps.

6. The buoyancy compensator of claim 5 including a strap attached to each of said right and left side flaps for securing the flap to another portion of the buoyancy compensator, each of the pockets being provided with an opening through which the strap extends.

7. The buoyancy compensator of claim 5 in which the means for attaching each of the side flap pockets includes a hook and loop fastener on the side flap and a hook and loop fastener on the pocket.

8. The buoyancy compensator of claim 5 including right and left shoulder flap pockets removably inserted over the right and left shoulder flaps, respectively, and means for removably attaching the shoulder flap pockets to the shoulder flaps.

9. The buoyancy compensator of claim 8 including a strap attached to each of the shoulder flaps for securing the shoulder flap to another portion of the buoyancy compensator, each of the shoulder flap pockets being provided with an opening through which the strap extends.

10. The buoyancy compensator of claim 8 in which the means for attaching each of the shoulder flap pockets includes a hook and loop fastener on the shoulder flap and a hook and loop fastener on the shoulder flap pocket.

11. A buoyancy compensator comprising a vest having a back portion, right and left side flaps, and right and left shoulder flaps, right and left shoulder flap pockets removably inserted over the right and left shoulder flaps, respectively, said right and left flaps extending into but not through said right and left pockets, and means for removably attaching the pockets to the shoulder flaps.

12. The buoyancy compensator of claim 11 including a strap attached to each of the shoulder flaps for securing the shoulder flap to another portion of the buoyancy compensator, each of the pockets being provided with an opening through which the strap extends.

13. The buoyancy compensator of claim 11 in which the means for attaching each of the shoulder flap pockets includes a hook and loop fastener on the shoulder flap and a hook and loop fastener on the pocket.

14. The buoyancy compensator of claim 1, wherein the vest and pocket have different colors.

* * * * *